US007810642B2

(12) United States Patent
Cheng et al.

(10) Patent No.: US 7,810,642 B2
(45) Date of Patent: Oct. 12, 2010

(54) PACKAGING CUSHION ASSEMBLY HAVING ONE FOLDABLE/UNFOLDABLE SIDE

(75) Inventors: Sheng-Hsiung Cheng, Taipei Hsien (TW); Te-An Lin, Taipei Hsien (TW); Wu-Nan Wang, Taipei Hsien (TW); Chia-Chia Huang, Taipei Hsien (TW)

(73) Assignee: Aopen Inc., Taopen Hsien (TW)

( * ) Notice: Subject to any disclaimer, the term of this patent is extended or adjusted under 35 U.S.C. 154(b) by 295 days.

(21) Appl. No.: 11/849,818

(22) Filed: Sep. 4, 2007

(65) Prior Publication Data

US 2008/0105592 A1 May 8, 2008

(30) Foreign Application Priority Data

Nov. 7, 2006 (TW) ..... 95141106 A

(51) Int. Cl.
*B65D 85/00* (2006.01)
*B65D 5/00* (2006.01)

(52) U.S. Cl. ..... 206/523; 206/320; 206/521

(58) Field of Classification Search ..... 206/521, 206/523, 586, 592, 585, 320; 229/178, 167, 229/177

See application file for complete search history.

(56) References Cited

U.S. PATENT DOCUMENTS 1,792,627 A * 2/1931 Bowersock ..... 206/591
2,707,587 A * 5/1955 Wittstein ..... 229/125.19
4,339,039 A * 7/1982 Mykleby ..... 206/523
4,441,451 A * 4/1984 Neal ..... 119/168
4,953,705 A * 9/1990 Evamy ..... 206/594
6,530,480 B1 * 3/2003 Hardy ..... 206/586
6,904,734 B2 * 6/2005 Hardy ..... 53/399
6,981,589 B2 * 1/2006 Sanders, Jr. ..... 206/320
2002/0060165 A1 * 5/2002 Weder ..... 206/423
2005/0023162 A1 * 2/2005 Hsu ..... 206/320

* cited by examiner

*Primary Examiner*—Mickey Yu
*Assistant Examiner*—Steven A. Reynolds
(74) *Attorney, Agent, or Firm*—Stephen A. Bent; Foley & Lardner LLP

(57) ABSTRACT

A packaging cushion assembly includes two cushion modules each including a main cushion unit and a foldable cushion plate. The main cushion unit has a base, two first sidewalls extending from two first sides of the base, a second sidewall extending from a second side of the base and having two ends connected to the first sidewalls, and an extension side spaced apart from the second sidewall and extending between the first sidewalls. The foldable cushion plate is adhered to the base, and has a movable wall projecting from the extension side and turnable relative to the base to move to an unfolded or folded position so that the cushion modules can be assembled together to form a first or second packaging configuration.

12 Claims, 8 Drawing Sheets

PACKAGING CUSHION ASSEMBLY HAVING ONE FOLDABLE/UNFOLDABLE SIDE

CROSS-REFERENCE TO RELATED APPLICATION

This application claims priority of Taiwanese Application No. 095141106, filed on Nov. 7, 2006.

BACKGROUND OF THE INVENTION

1. Field of the Invention

The invention relates to a packaging assembly, more particularly to a packaging cushion assembly that has at least one cushion module with one foldable/unfoldable side, and that may be suitably used to package different sizes of articles.

2. Description of the Related Art

Computer housings commonly available in the market are formed to various sizes to accommodate different specifications of computers. This is referred to as "form factor", examples of which include the advanced technology extended (ATX), micro ATX, balanced technology extended (BTX), and micro BTX form factors. The ATX form factor, which was established by Intel in 1995, is the most common form factor. The computer housing produced according to the ATX specification must have seven slots, more than three 3.5" storage devices, and more than three 5.25" storage devices, and the total volume thereof is about 15 liters. Most manufacturers producing this kind of computer housing use a mold that forms a one-piece, integral computer housing. Thus, during delivery, each computer housing occupies a volume of at least 15 liters (often significantly more) if a cushion material is added to protect an outer surface of the computer housing. For example, with reference to FIG. 1, a Styrofoam cushion side board 1 usually used in packing the computer housing can increase the volume of the computer housing to up to more than 20 liters.

Therefore, there has been developed an improved computer housing having side panels that can be disassembled and laid flat. After the computer housing reaches a distributor, where different components of the computer housing are installed, the computer housing is reassembled. Hence, such an improved computer housing has a volume that is largely reduced during delivery from the factory to the distributor as compared to the abovementioned computer housing. However, when the improved computer housing is reassembled, the distributor must separately prepare a suitable cushion material for the reassembled computer housing prior to delivery to a customer. This results in an increase in the packaging cost. Further, a large consumption of packaging materials has a negative impact on the environment.

SUMMARY OF THE INVENTION

Therefore, the object of the present invention is to provide a packaging cushion assembly that can be folded and unfolded at one side to accommodate different sizes of products to be packed.

According to one aspect of this invention, a packaging cushion assembly comprises two cushion modules, each of which includes a main cushion unit and a foldable cushion plate. The main cushion unit has a base, two first sidewalls, a second sidewall, and an extension side. The base has two opposite first sides parallel to a first line, and a second side parallel to a second line. The first and second lines intersect each other at a geometrical center of the base. The first sidewalls are spaced apart from each other along the second line, and extend perpendicularly and away from the first sides of the base. The second sidewall extends perpendicularly and away from the second side of the base, and has two ends respectively connected to ends of the first sidewalls. The extension side is provided on a side of the base that is spaced apart from the second sidewall and that extends between inner surfaces of the first sidewalls. The foldable cushion plate is adhered to the base, and has a movable wall projecting from the extension side of the base in a direction away from the second sidewall. The movable wall is turnable relative to the base to move to an unfolded position or a folded position so as to allow the cushion modules to be assembled together to form a first packaging configuration or a second packaging configuration.

In the first packaging configuration, the movable wall is in the unfolded position and is substantially parallel to the base. The cushion modules are inverted relative to each other and disposed one behind the other along the first line. The movable wall of one of the cushion modules covers top edges of the first and second sidewalls of the other one of the cushion modules.

In the second packaging configuration, the movable wall is in the folded position and is perpendicular to the base. The base, the first sidewalls, the second sidewall, and the movable wall of each of the cushion modules cooperatively confine a fixing cavity. The fixing cavities of the cushion modules are opposite to and spaced apart from each other.

According to another aspect of this invention, a packaging cushion assembly comprises a molded main cushion unit and a foldable cushion plate. The molded main cushion unit includes a base that has two opposite first sides, a second side connected between the first sides, and an extension side opposite to the second side. The main cushion unit further includes two first sidewalls extending upwardly and respectively from the first sides, and a second sidewall extending upwardly from the second side. The foldable cushion plate is attached to the base, and has a movable wall projecting from the extension side. The movable wall is turnable relative to the base to move to a folded position in which the movable wall extends upward from the base, or an unfolded position in which the movable wall is substantially parallel to the base.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
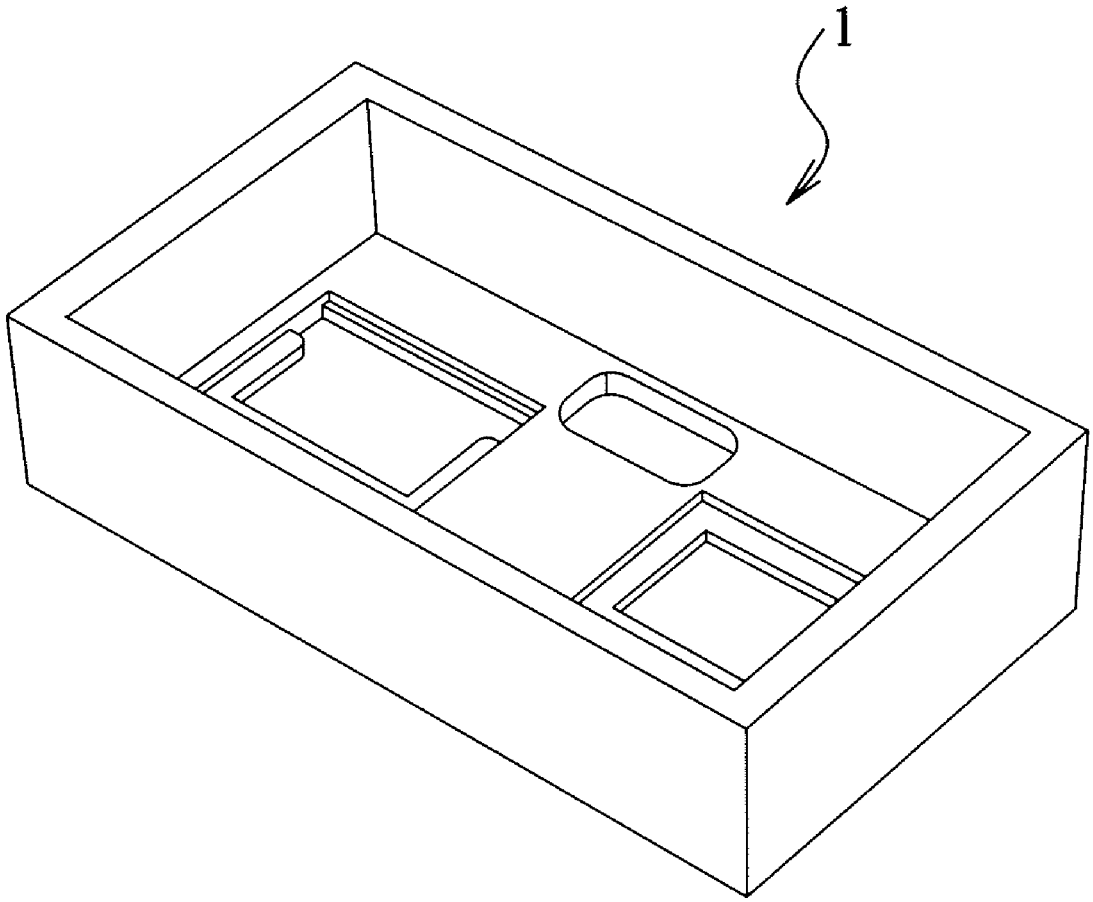
F I G. 1 PRIOR ART
FIG. 1 is a perspective view of a conventional cushion sideboard used in packing a computer housing.
Figure 2:
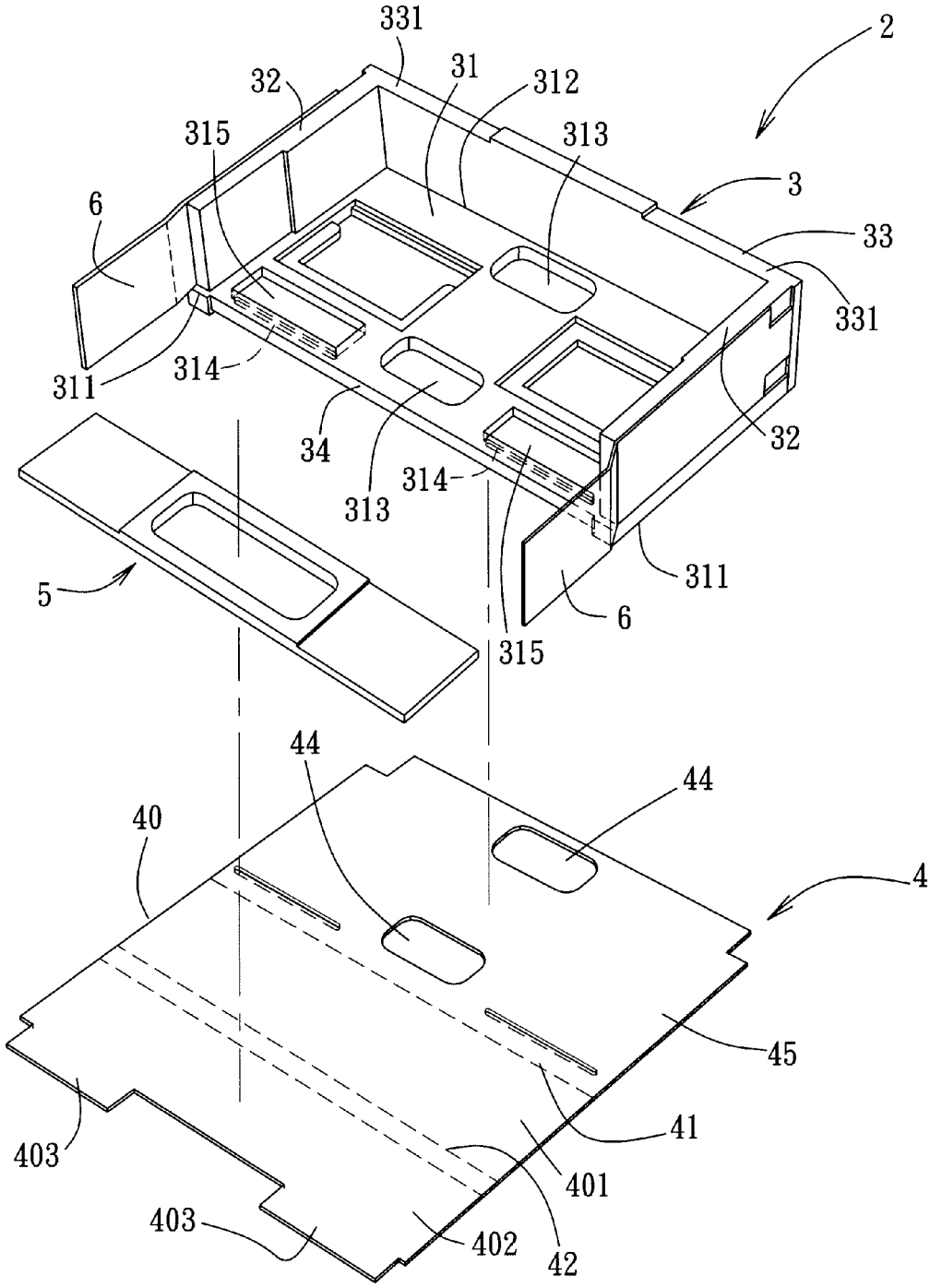
FIG. 2 is an exploded perspective view of a cushion module of a preferred embodiment of a packaging cushion assembly according to the present invention.

Referring to FIGS. 2 to 8, the preferred embodiment of a packaging cushion assembly according to the present invention is shown to comprise two cushion modules 2 each having a single side that can be unfolded.

Each cushion module 2 includes a main cushion unit 3, a foldable cushion plate 4, a cushion component 5, and two fixing plates 6.

The main cushion unit 3 has a generally rectangular base 31, two first sidewalls 32 extending upwardly and respectively from two opposite first sides 311 of the base 31, a second sidewall 33 extending upward from a second side 312 of the base 31 and connected to one end of each first sidewall 32, and an extension side 34 spaced apart from the second sidewall 33 and extending between inner surfaces of the first sidewalls 32. First and second lines (L1) and (L2) pass through the geometrical center of the base 31 and intersect each other. The two opposite first sides 311 of the base 31 are parallel to the first line (L1), and the second side 312 of the base 31 is parallel to the second line (L2). The base 31 further has two hand holes 313 spaced apart along the first line (L1) and respectively disposed on two opposite sides of the second line (L2), and two engaging grooves 314 located proximate to a lateral side of the base 31 and disposed respectively on two opposite sides of the first line (L1). The base 31 is molded from plastic, and is formed with two rectangular indentations 315. In this embodiment, the engaging grooves 314 are each disposed at one side of the indentation 315. However, in practice, the location of the engaging grooves 314 is not limited thereto.

The first sidewalls 32 are spaced apart from each other along the second line (L2), and extend upward laterally and perpendicularly from the base 31. The second sidewall 33 extends upward laterally and perpendicularly from the base 31 opposite to the engaging grooves 314. Further, the second sidewall 33 has two opposite ends respectively connected to the ends of the first sidewalls 32. A top end of the second sidewall 33 is formed with two engaging grooves 331 respectively located on two opposite sides of the first line (L1). The first sidewalls 32 and the second sidewall 33 form a substantially U-shaped configuration after being interconnected. In this embodiment, the main cushion unit 3 is made of Styrofoam.

The foldable cushion plate 4 is adhered to a bottom face of the base 31, and has a movable wall 40 that projects outward from the extension side 34 of the base 31 in a direction away from the second sidewall 33 of the main cushion unit 3. The foldable cushion plate 4 of each cushion module 2 further has a first fold line 41 that is parallel to the second line (L2), that is adjacent to the extension side 34 of the main cushion unit 3, and that extends between side edges of the first sidewalls 32, and two second fold lines 42 that are disposed away from the base 31 and parallel to the first fold line 41, and that are spaced apart from the first fold line 41 at a distance (S) (see FIG. 3). The distance (S) is equal to the distance between the base 31 and a top end of either one of the first sidewalls 32. The movable wall 40 has a first wall portion 401 located between the first and second fold lines 41, 42, a second wall portion 402 extending from the second fold lines 42 in a direction away from the second sidewall 33, and two spaced-apart engaging portions 403 extending from one end of the second wall portion 402 disposed away from the second fold lines 42. In this embodiment, the foldable cushion plate 4 is made of thick cardboard. Further, in order to avoid covering the handle holes 313 in the base 31, two corresponding through holes 44 are provided in the foldable cushion plate 4.

The cushion member 5 is adhered to the second wall portion 402 of the movable wall 40. Further, the cushion member 5 is made of Styrofoam to absorb vibration.

The fixing plates 6 are adhered respectively to outer faces of the first sidewalls 32 of the main cushion unit 3, and extend in a direction away from the second sidewall 33 of the main cushion unit 3. The fixing plates 6 have portions protruding out of the extension side 34 of the main cushion unit 3.

Figure 5:
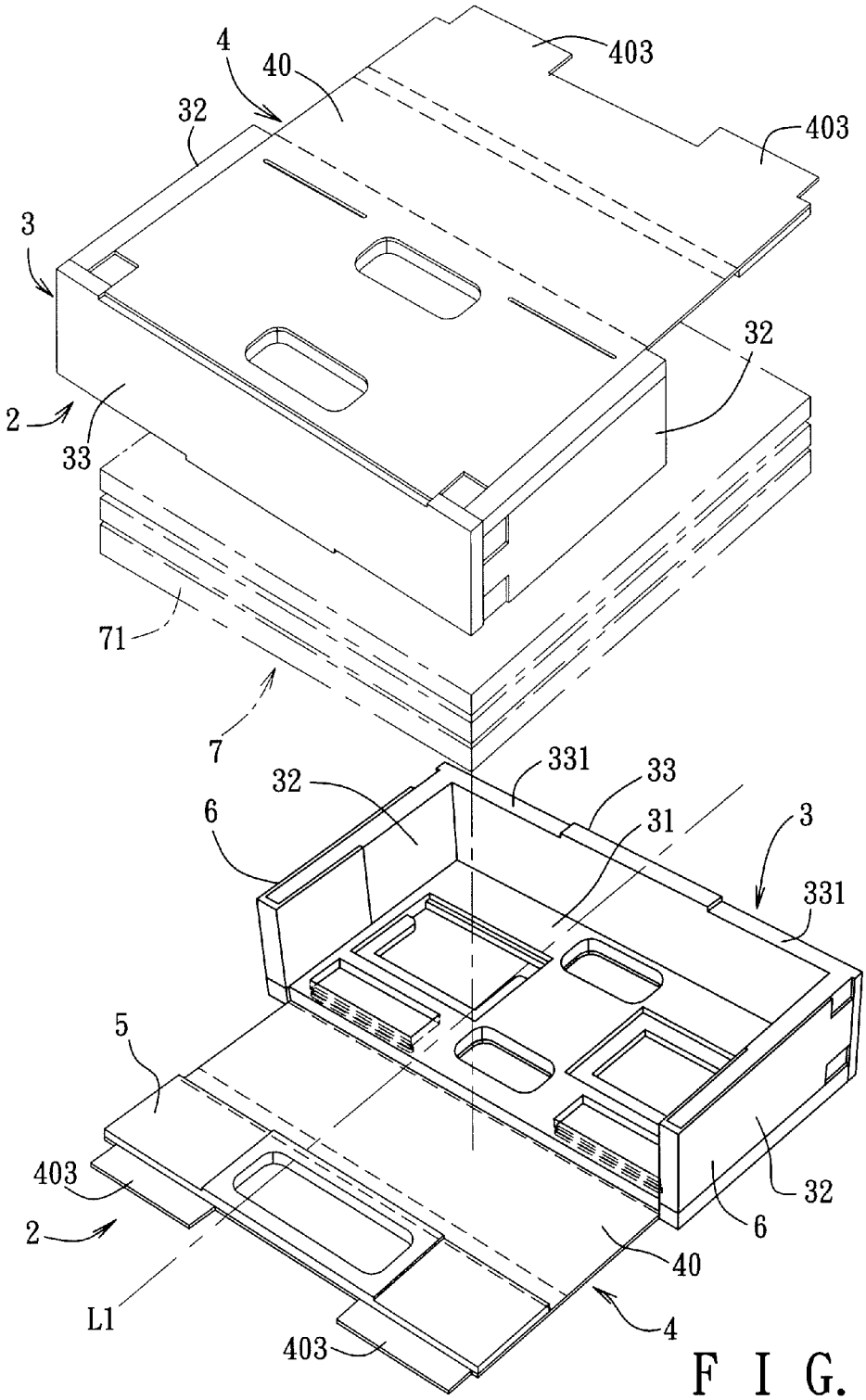
FIG. 5 is a perspective view of the preferred embodiment in the first packaging configuration.
Figure 7:
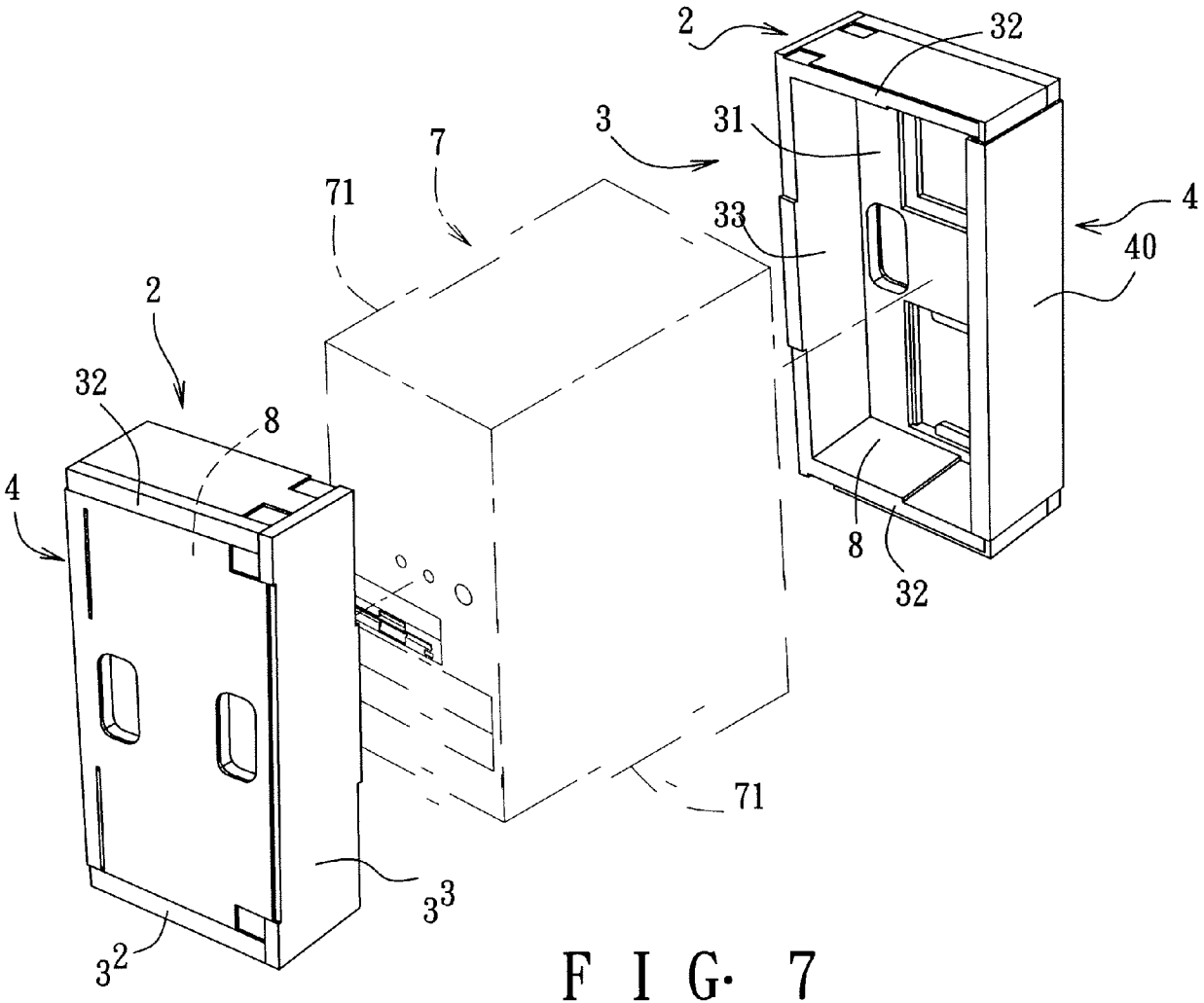
FIG. 7 is a perspective view of the preferred embodiment in the second packaging configuration.
Figure 8:
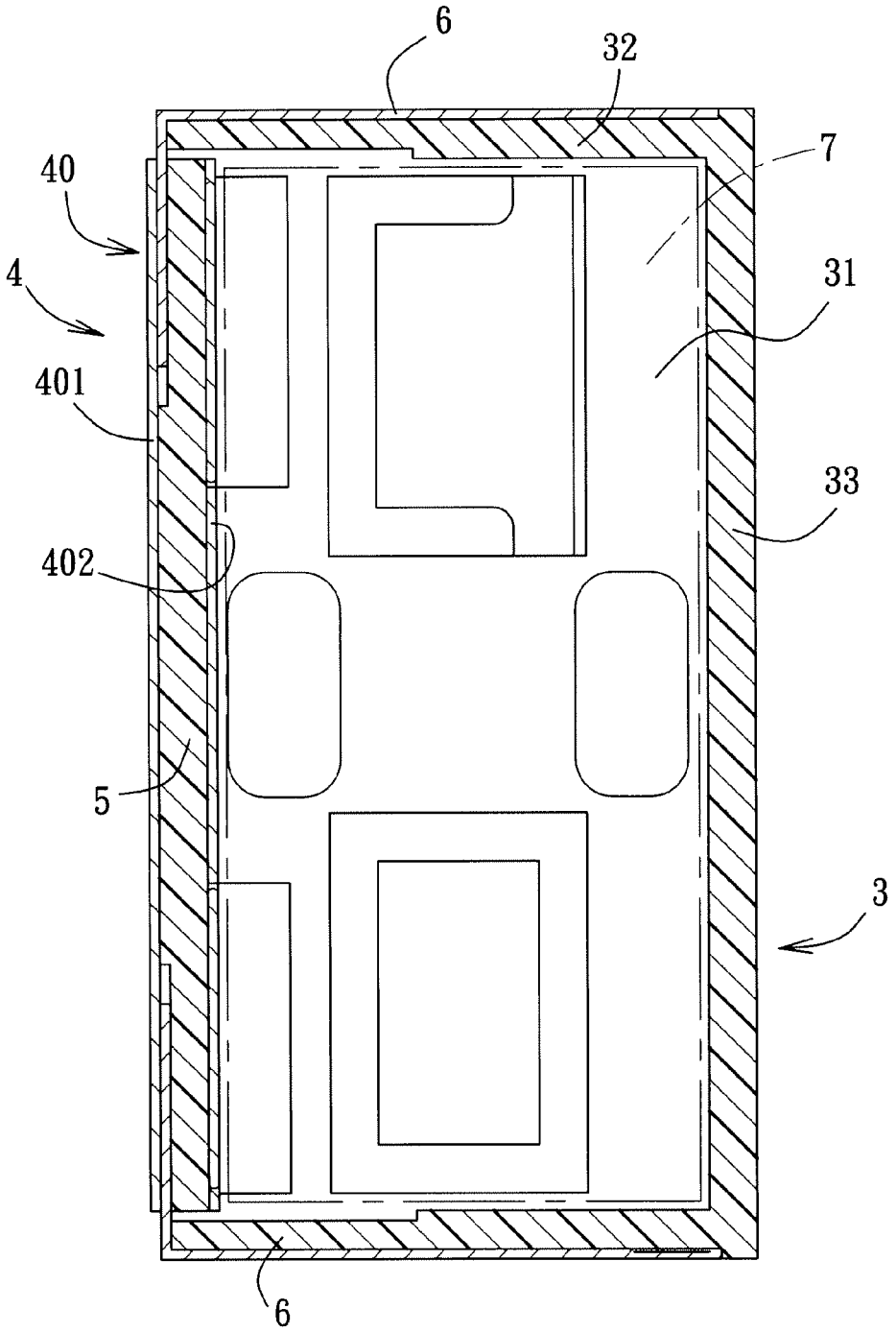
FIG. 8 is a sectional side view showing one of the cushion modules of the preferred embodiment in the second packaging configuration.

With particular reference to FIGS. 5 and 7, the cushion modules 2 may be assembled variably to correspond to different configurations of a computer housing 7 for packaging of the same. The computer housing 7 has a plurality of side panels 71 that can be disassembled and arranged in a stack so as to reduce the volume of the computer housing 7.

The movable wall 40 of the foldable cushion plate 4 of each cushion module 2 is turnable relative to the base 31 to move between a folded position and an unfolded position so that the cushion modules 2, after being assembled together, form a first or second packaging configuration to suit the varying configuration of the computer housing 7.

Figure 4:
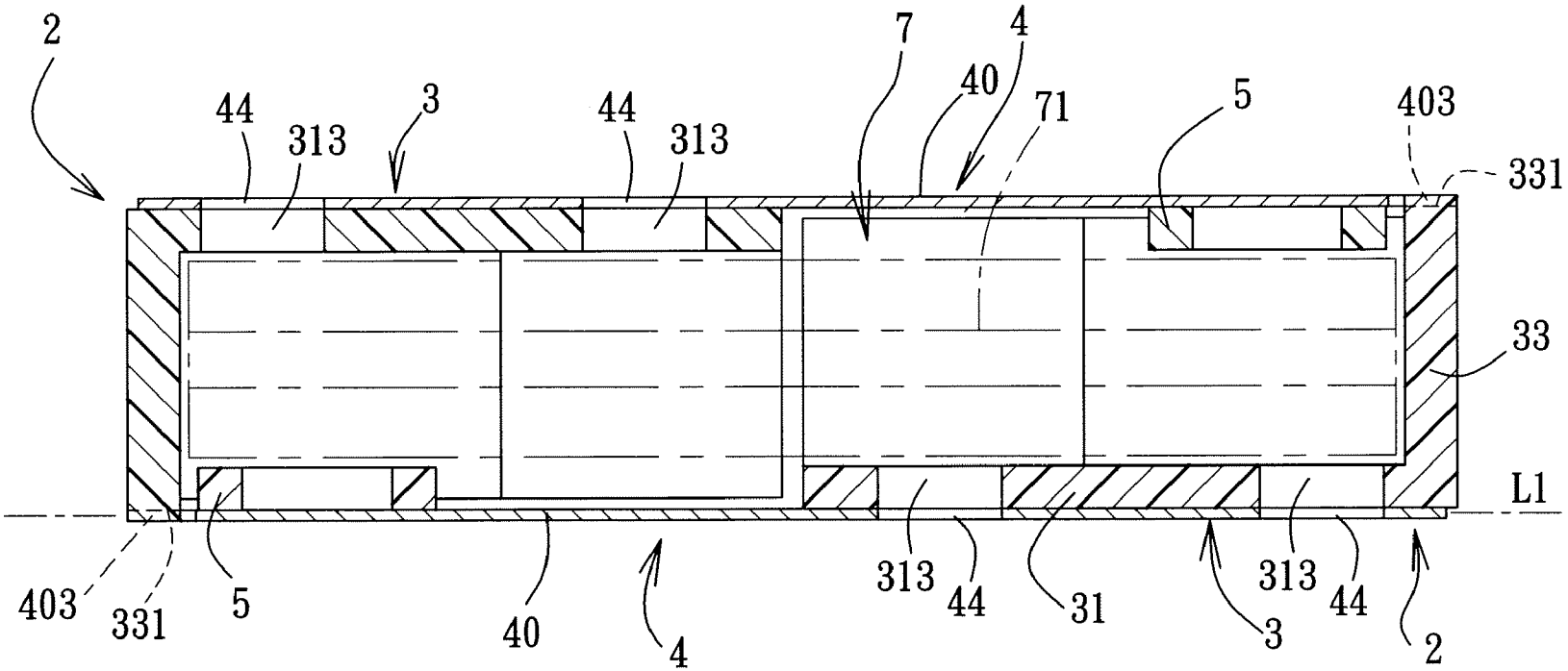
FIG. 4 is a sectional side view of the preferred embodiment in a first packaging configuration.

Referring to FIGS. 4 and 5, in the first packaging configuration, the cushion modules 2 are inverted relative to each other, and are arranged one above the other and one behind the other along the first line (L1). In addition, the movable wall 40 of one of the cushion modules 2 covers the top edges of the first and second sidewalls 32, 33 of the other one of the cushion modules 2. The engaging portions 403 of the movable wall 40 of each of the cushion modules 2 extend respectively into the engaging grooves 331 in the second sidewall 33 of the other one of the cushion modules 2.

When the computer housing 7 is to be packed for transport from a factory, the side panels 71 are separated and stacked. In this state, the computer housing 7 is packed using the first packaging configuration of the cushion modules 2. As shown in FIG. 4, the computer housing 7 is laid flat and enclosed within a space formed by the cushion modules 2, and is thus cushioned and protected adequately.

Figure 6:
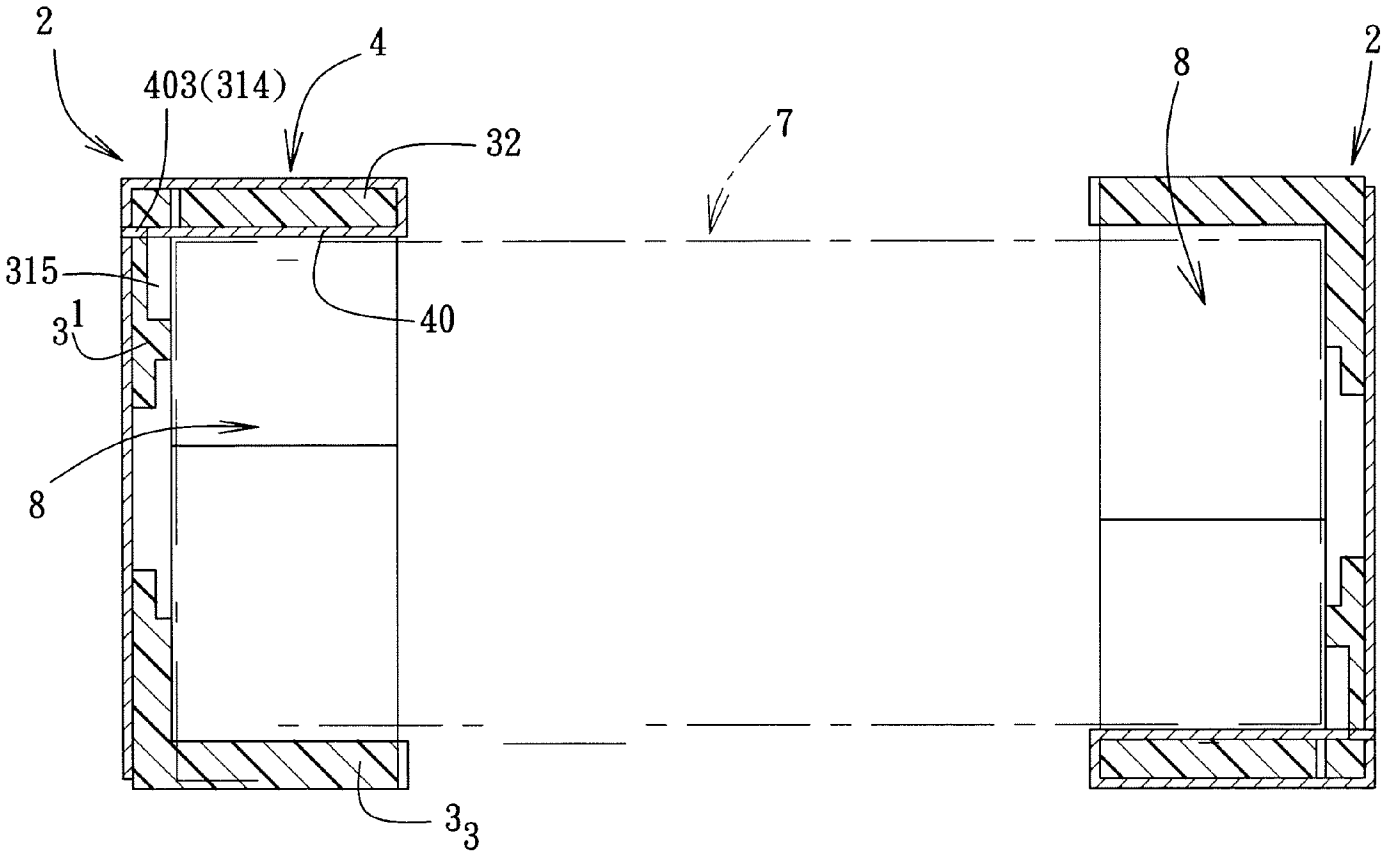
FIG. 6 is a sectional top view of the preferred embodiment in a second packaging configuration.

Referring to FIGS. 6 and 7, in the second packaging configuration, the base 31, the first and second sidewalls 32, 33, and the movable wall 40 of each cushion module 2 cooperatively confine a fixing cavity 8. The fixing cavities 8 of the cushion modules 2 are opposite to and spaced apart from each other so as to clamp respectively front and rear sides of the computer housing 7. As such, the computer housing 7 is clamped between the two cushion modules 2, as best shown in FIG. 6. In the second packaging configuration, the movable wall 40 of each cushion module 2 is placed in a folded position and is substantially perpendicular to the base 31. The method of folding the movable wall 40 of each cushion module 2 will now be described.

Figure 3:
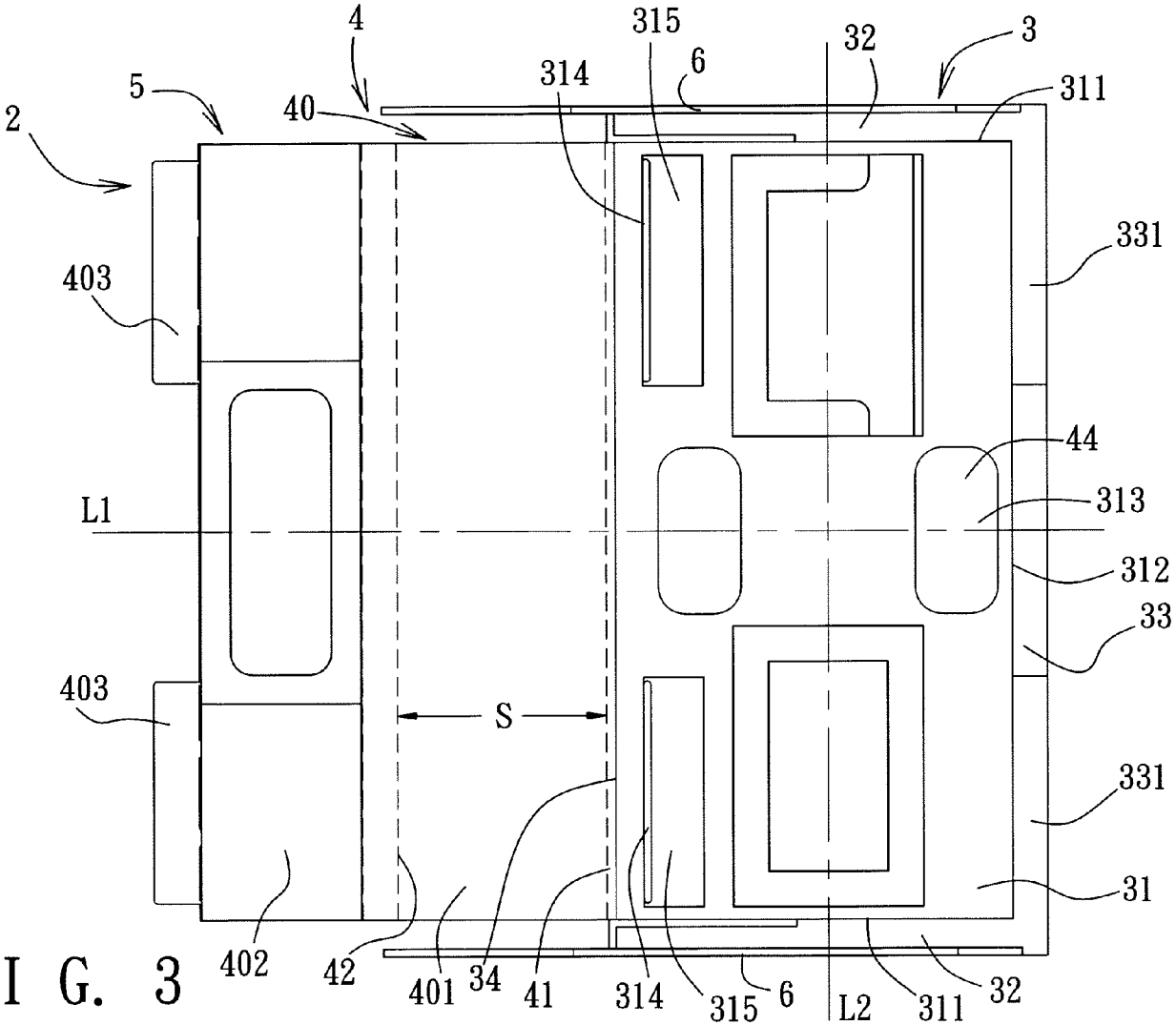
FIG. 3 is a schematic top view of one cushion module of the preferred embodiment.

Reference is made again to FIGS. 3 and 6. FIG. 3 shows a state in which one of the cushion modules 2 is ready to be formed into the first packaging configuration. Firstly, the first wall portion 401 of the movable wall 40 is bent upward by turning about the first fold line 41, which is used as a rotation axis at this time.

Thereafter, the fixing plates 6 are bent toward the movable wall 40, and are adhered fixedly to one side of the first wall portion 401 that faces the base 31. The second wall portion 402 of the movable wall 40, together with the cushion pad 5, is then bent downward along the second fold line 42 and turned to the first wall portion 401 and the base 31. The second wall portion 402 thus cooperates with the first wall portion 401 to clamp and fix by adhesion the fixing plates 6.

The fixing plates 6 are therefore disposed between the first and second wall portions 401, 402.

As a result, the base 31, the first and second sidewalls 32, 33, and the movable wall 40 of the foldable cushion unit 4 of each cushion module 2 confine the corresponding fixing cavity 8. The cushion modules 2 function to package the computer housing 7 by means of the fixing cavities 8.

Finally, the engaging portions 403 of the movable walls 40 of the foldable cushion plates 4 are respectively engaged to the engaging grooves 314 in the bases 31 of the main cushion units 3.

After the side panels 71 are assembled to form the three dimensional configuration of the computer housing 7, the second packaging configuration may be used to package the computer housing 7. As shown in FIG. 7, the computer housing 7 is clamped between the cushion modules 2 for packaging of the same.

As mentioned above, each cushion module 2 of the packaging cushion assembly according to the present invention comprises the main cushion unit 3 that is molded from Styrofoam, and the foldable cushion plate 4. The foldable cushion plate 4 is attached to the base 31, and has the movable wall 40 projecting from the extension side 34. The movable wall 40 is turnable relative to the base 31 to move to a folded position in which the movable wall 40 extends upward from the base 31, or an unfolded position in which the movable wall 40 is substantially parallel to the base 31. The foldable cushion plate 4 further has a cushion pad 5 attached to the second wall portion 402. Alternatively, the cushion pad 5 may be attached to the first wall portion 401. The cushion pad 5 is sandwiched between the first and second wall portions 401, 402 when the movable wall 40 is in the folded position. Therefore, due to the presence of the movable wall 40 configured in this manner, the packaging cushion assembly of the present invention is provided with one foldable/unfoldable sidewall.

In sum, the packaging cushion assembly according to the present invention can be assembled to form different configurations so as to fit differently sized products. When the cushion modules 2 are in the first packaging configuration, the volume of the packaging cushion assembly is effectively reduced. When the cushion modules 2 are in the second packaging configuration, a product of a large volume can be packed without the need to change the cushion materials.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A packaging cushion assembly, comprising:

two cushion modules, each of which includes:

a main cushion unit having:

a base having two opposite first sides parallel to a first line, and a second side parallel to a second line, said first and second lines intersecting each other at a geometrical center of said base;

two first sidewalls spaced apart from each other along said second line and extending perpendicularly from said first sides of said base, respectively;

a second sidewall extending perpendicularly from said second side of said base and having two ends respectively connected to ends of said first sidewalls; and an extension side provided at one side of said base that is spaced apart from said second sidewall and that extends between inner surfaces of said first sidewalls; and a foldable cushion plate adhered to said base and having a movable wall projecting from said extension side of said base in a direction away from said second sidewall, said movable wall being turnable relative to said base to move to an unfolded position or a folded position so that said cushion modules can be assembled together to form a first packaging configuration or a second packaging configuration, wherein, in the first packaging configuration, said movable wall is in said unfolded position and is substantially parallel to said base, said cushion modules being inverted relative to each other and disposed one behind the other along said first line, said movable wall of one of said cushion modules covering top edges of said first and second sidewalls of the other one of said cushion modules, and wherein, in the second packaging configuration, said movable wall is in said folded position and is perpendicular to said base, said base, said first sidewalls, said second sidewall, and said movable wall of each of said cushion modules cooperatively confine a fixing cavity, said fixing cavities of said cushion modules being opposite to and spaced apart from each other.

2. The packaging cushion assembly of claim 1, wherein said foldable cushion plate of each of said cushion modules has a first fold line that is parallel to said second line, that is proximate to said extension side, and that is located between side edges of said first sidewalls, and two second fold lines that are disposed away from said base and parallel to said first fold line, and that are spaced apart from said first fold line at a distance, said distance being equal to the distance between said base and a top end of any one of said first sidewalls, said movable wall having a first wall portion located between said first and second fold lines, and a second wall portion extending from one of said second fold lines in a direction away from said second sidewall of said main cushion unit.

3. The packaging cushion assembly of claim 2, wherein said first wall portion is bent upward about said first fold line that serves as a rotation axis, said second wall portion being bent along one of said second fold lines and turned to said first wall portion and said base, said second wall portion having an edge fixed to said base so that said movable wall is placed in said folded position.

4. The packaging cushion assembly of claim 2, wherein said second wall portion of said movable wall has a cushion member adhered thereto.

5. The packaging cushion assembly of claim 4, wherein said cushion member is made of Styrofoam.

6. The packaging cushion assembly of claim 3, wherein each of said cushion modules further includes a plurality of fixing plates adhered to outer faces of said first sidewalls of said main cushion unit and extending in a direction away from said second sidewall of said main cushion unit, said fixing plates having portions protruding out of said extension side of said main cushion unit.

7. The packaging cushion assembly of claim 6, wherein, when said cushion modules are in said second packaging configuration, said fixing plates are bent toward said movable wall, and arc inserted between said first and second wall portions of said movable wall.

8. The packaging cushion assembly of claim 2, wherein said movable wall of each of said cushion modules further has a plurality of spaced-apart engaging portions extending from one end of said second wall portion disposed away from said second fold lines, said base being formed with a plurality of engaging grooves near a lateral side of said base proximate to said movable wall, said engaging portions and said engaging grooves engaging each other respectively when said cushion modules are in said second packaging configuration.

9. The packaging cushion assembly of claim 2, wherein said movable wall of each of said cushion modules further has a plurality of spaced-apart engaging portions extending from one end of said second wall portion away from said second fold lines, said second sidewall of said main cushion unit having a top end formed with a plurality of engaging grooves, said engaging portions extending respectively into said engaging grooves of said second sidewall when said cushion modules are in said first packaging configuration.

10. The packaging cushion assembly of claim 1, wherein said main cushion units of said cushion modules are made from Styrofoam.

11. The packaging cushion assembly of claim 1, wherein said foldable cushion plates of said cushion modules arc made of thick cardboard.

12. The packaging cushion assembly of claim 1, wherein said base of said main cushion unit of each of said cushion modules is formed with a plurality of hand holes.

* * * * *